United States Patent [19]

Eley et al.

[11] 4,311,445

[45] Jan. 19, 1982

[54] CONTAMINANT RESISTANT GEAR PUMPS AND MOTORS WITH WEAR INSERTS

[75] Inventors: James M. Eley; Arthur B. Joyce, both of Corinth, Miss.

[73] Assignee: Tyrone Hydraulics, Inc., Corinth, Miss.

[21] Appl. No.: 89,302

[22] Filed: Oct. 30, 1979

[51] Int. Cl.[3] ..... F03C 2/08; F04C 2/18; F04C 15/00

[52] U.S. Cl. ..... 418/132; 418/178; 418/179

[58] Field of Search ..... 418/131–135, 418/178, 179

[56] References Cited

U.S. PATENT DOCUMENTS

| | | | |
|---|---|---|---|
| 1,118,533 | 11/1914 | Crocker | 418/127 |
| 1,783,209 | 12/1930 | Wilsey | 418/129 |
| 1,897,560 | 2/1933 | Lawser | 418/206 |
| 2,622,534 | 12/1952 | Johnson | 418/126 |
| 2,639,694 | 5/1953 | Johnson | 418/206 |
| 2,742,862 | 4/1956 | Banker | 418/126 |
| 2,855,854 | 10/1958 | Aspelin | 418/126 |
| 2,982,220 | 5/1961 | Kane | 418/179 |
| 3,315,609 | 4/1967 | Eckerle | 418/73 |
| 3,427,985 | 2/1969 | Difford | 418/126 |
| 3,429,270 | 2/1969 | Noell et al. | 418/206 |
| 3,472,170 | 10/1969 | Eckerle | 418/126 |
| 3,498,232 | 3/1970 | Noell et al. | 418/126 |
| 3,499,390 | 3/1970 | Prijatel | 418/132 |
| 3,632,240 | 1/1972 | Dworak | 418/179 |

FOREIGN PATENT DOCUMENTS

| | | |
|---|---|---|
| 625405 | 2/1936 | Fed. Rep. of Germany . |
| 1267987 | 5/1968 | Fed. Rep. of Germany . |

*Primary Examiner*—John J. Vrablik
*Attorney, Agent, or Firm*—Charles H. Lindrooth

[57] ABSTRACT

Hydraulic equipment useful as a pump or motor intended for applications where hydraulic fluid is exposed to contamination by abrasive particulate material is disclosed. Leakage paths from the high pressure chamber in a gear pump or motor are provided with inserts of an abrasion and erosion resistant material at points where wear from abrasives in the hydraulic fluid is aggravated. In particular, the bearing surfaces of the pressure loaded side plates are provided with an insert of abrasion and erosion resistant material in the mesh region of the teeth. Erosion and abrasion resistant rings are located on the side plates in the region surrounding the openings for the shafts and extending interiorly of the tooth root circle to the journal bearings.

Also disclosed are radial sealing shoes which are supported by the side plates and are radially urged into sealing relationship with the tips of the teeth by the pressure existing at the high pressure side of the gears.

3 Claims, 9 Drawing Figures

14
14b
16
16
22
10a
10
20
29
12
28
26
19
23
21
15
32
33
25a
25
32
23
27
24
26
13
29
22
11a
11
16
16

CONTAMINANT RESISTANT GEAR PUMPS AND MOTORS WITH WEAR INSERTS

FIELD OF THE INVENTION

The invention relates to improvements in hydraulic equipment such as gear pumps and motors and more particularly to improvements which increase the suitability of high performance gear pumps and motors for use in working environments wherein large amounts of abrasive particulate materials are present.

RELATED APPLICATIONS

This application is related to application Ser. No. 29,891 filed Apr. 13, 1979, now U.S. Pat. No. 4,266,195 issued May 12, 1981 in the name of James M. Eley and James R. McBurnett and owned by the assignee of this application.

BACKGROUND OF THE INVENTION

Hydraulic equipment, and in particular high performance pumps and motors used in applications where there is a large amount of particulate contaminant material are found to be subject to an unusually high degree of wear. The problem is particularly troublesome in underground mining operations where maintenance is difficult to accomplish and equipment is frequently run on a round-the-clock basis. Not infrequently, hydraulic pumps will last no longer than about three months due to wear caused by the presence of highly abrasive particulate contaminants in the hydraulic fluid. The particulate contaminants in the hydraulic fluid abrade and erode critical sealing surfaces within the pumps and motors and at the end of a relatively short time, volumetric efficiency has dropped to the point where the pump or motor is very inefficient. This operating inefficiency, among other things, leads to overheating of the hydraulic fluid and eventually to failure of the pump. Because the occurance of such failures is relatively unpredictable and inspection and monitoring of pump efficiency is not easily carried out, particularly in underground mines, the practice has developed to simply replace the hydraulic pumps and motors at relatively short intervals in order to avoid problems.

Significant reductions in wear due to contaminated hydraulic fluid are achieved through the use of gear pumps and motors constructed in accordance with the teachings of copending application Ser. No. 29,891. In that application a construction is disclosed in which radially movable sealing elements provide a sealing surface with the tips of the gear teeth adjacent the high pressure port of the pump or motor. These elements are pressure compensated to eliminate slippage caused by wear at the tips of the teeth by maintaining a good seal with the tips of the teeth despite wear which may occur due to the presence of contaminants in the hydraulic fluid.

Another leakage path in gear pumps and motors is between the sides of the teeth and the side walls of the pumping chamber. It is known in the prior art that the side walls should be comprised of pressure compensated plates which are pressed against the sides of the teeth by fluid pressure which is communicated against the outsides of the plates from the high pressure side of the pump or motor.

Another type of leakage path which is aggravated at high pressures exists in certain regions of the pressure plates interfacing with the gears where there is an abrupt transition from high to low pressure.

One such leakage path exists at the surface of the plates bounding the mesh region of the gears. Where the gears mesh there is a point of contact which moves along a path termed the path of contact which is the demarcation line between high and low pressures. Although there is little or no leakage between the teeth when the gears are rotating, the points along this line at the boundaries of the teeth have been discovered to be natural leakage paths in which the pressure plates are subjected to a higher degree of wear and abrasion than the rest of their surface. So far as we can determine, the prior art contains no solution to the problem other than careful maintenance and avoidance of oil contamination by use of filters or the like.

The other point where a large pressure drop may exist is between the root circle of the gears and the shaft bearings. Although the existence of this leakage path has been recognized, where journal bearings have been employed it has been considered to be necessary for lubrication of the bearings or at least an expedient solution to the lubrication problem.

Even though the side plates are pressure compensated so as to keep the side plates pressed against the sides of the teeth despite wear of the side plates, they are still susceptible to damage by abrasive and erosive action of contaminants in the hydraulic fluid in the sealing area between the root circle of the teeth and the shafts on which the gears are mounted.

The susceptibility to damage of the type to which this invention relates is attributable to the fact that the surface of the pressure plate adjacent the teeth must be selected primarily for its ability to act as a bearing for the sides of the gear teeth which normally move at very high velocities. Available materials (primarily bronzes) that make good load bearing surfaces are relatively soft and offer little resistance to abrasive and erosive attack by particulate contaminants. As indicated above, pressure compensation of the side plates is a substantial solution to the problem of wear between the sides of the teeth and the pressure plate. However, it has been discovered that pressure compensation does not provide a solution to wear of the side plate in the teeth mesh region or interiorly or beneath the root circle of the teeth and in fact these areas are the ones most susceptible to damage by contaminants in gear pumps or motors.

Various other approaches to the problem of erosion and abrasion at the root circle are currently in use. One approach is to increase the root seal, thereby reducing the amount of leakage by increasing the distance between the root circle and the outside diameter of the gear shaft. The problem with this approach is that it can only be accomplished by reducing shaft diameter which leads to bearing failure or by increasing the overall size of the gears which also means an increase in the size of the pump housing and an appreciable increase in weight and in cost. Another approach has involved the pressurization of the ends of the housing so that there is no flow of oil into the bearing region. Attendant with this approach is an increase in the cost of the housing or a risk of increased pressure failure. Shaft sealing problems are also more difficult. Pressure compensation of the side plates is more difficult to accomplish due to difficulties in isolating high and low pressure regions at the back of the side plates. The bearings required for such applications must be roller or needle bearings.

SUMMARY OF THE INVENTION AND OBJECTS

The invention involves the use of a novel design of side plate wherein regions of abrupt transition from high to low pressure on the surfaces of the side plates, which regions are not pressure compensated, are formed of an erosion and abrasion resistant material.

An important objective of the invention is the provision of an improved form of pressure compensated side plate construction in which the sources of pressure plate wear referred to above are substantially reduced.

A more particular objective of the invention is the provision of abrasion and erosion resistant inserts in the mesh regions and the root seal regions of the pressure plate.

Still another objective of the invention is the reduction of wear and prolongation of life of gear pumps and motors used in environments where large amounts of particulate contaminants exist.

Still another objective of the invention is the provision of means in gear pumps and motors for maintaining high volumetric efficiency over a relatively long period of time.

In summary, the foregoing and various other objectives of the invention are achieved by the provision in a gear pump of pressure compensated side plates having an abrasion and erosion resistant material in the area of the plate immediately adjacent the gear shafts and extending radially outwardly to include the root circle of the gear teeth. An abrasion and erosion resistant insert is also disposed in the plates in the region adjacent the mesh region of the teeth.

The foregoing and other objectives and advantages of the invention will become apparent upon reference to the following detailed description of a preferred embodiment of the invention.

DETAILED DESCRIPTION OF THE INVENTION

Figure 1:
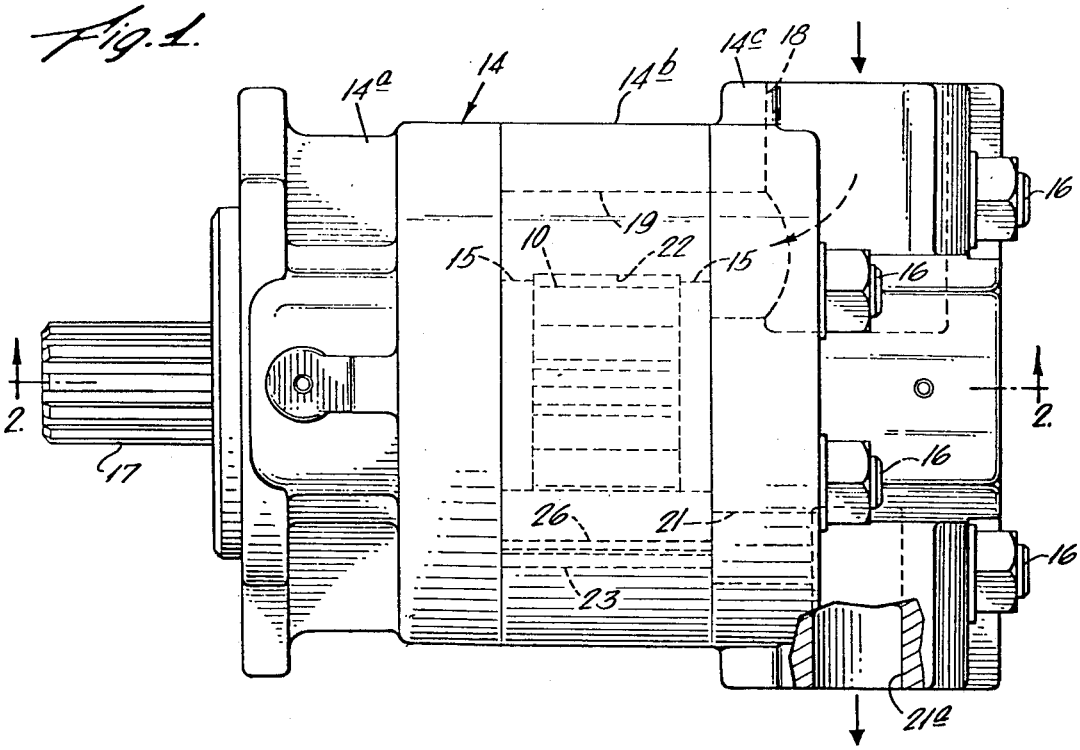
FIG. 1 is an exterior view of a typical hydraulic gear pump incorporating the principles of the present invention with a portion of the house broken away for illustrative purposes.
Figure 2:
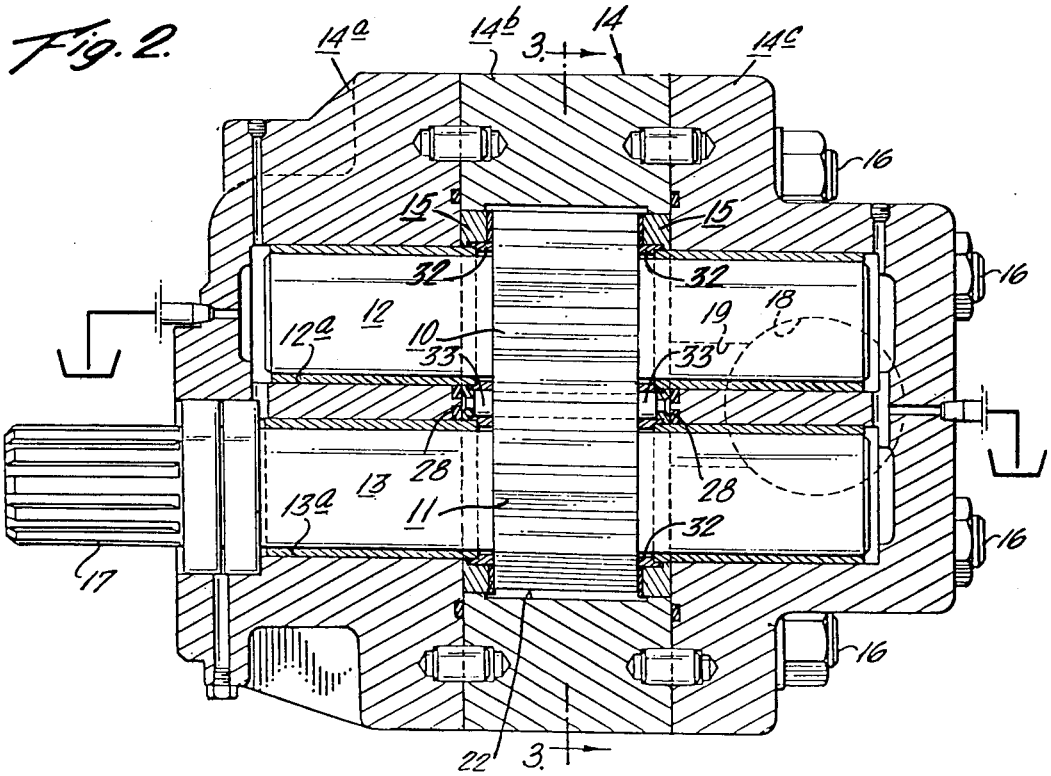
FIG. 2 is a section view taken on line 2—2 of FIG. 1.
Figure 3:
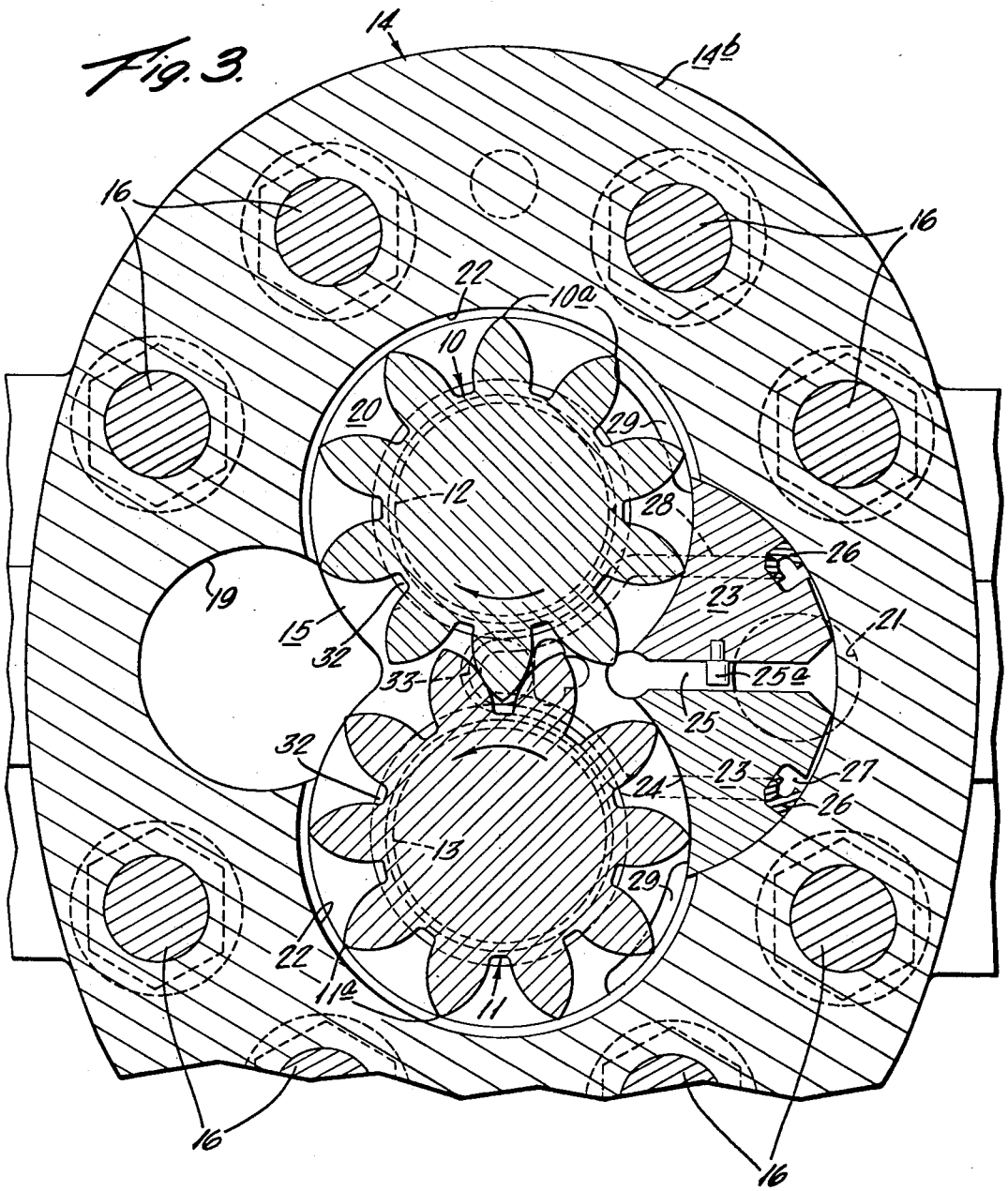
FIG. 3 is a section view taken along line 3—3 of FIG. 2.

Reference is first made to FIGS. 1 through 3 which show a gear pump in which a pair of gears 10 and 11 are provided as pumping elements for pumping hydraulic fluid from a reservoir to a hydraulically operated device not shown. Gears 10 and 11 are mounted on parallel shafts 12 and 13, best shown in FIG. 2 and preferably journalled within sleeve type bearings **12*a* and 13*a* within a housing 14. The housing is typically divided into 2 or more components, a three piece housing comprised of parts 14*a*, 14*b*, and 14*c*, being illustrated. The three components are secured together by suitable means such as bolt 16**.

As can be seen in FIGS. 1 and 2, shaft 13 projects out of the housing and is provided with a splined drive connection 17 forming a part of a drive means which also includes a prime mover, not shown.

An inlet line or passage represented at 18 in FIG. 1 and a portion bored at right angles at 19 leads to the hollow pumping chamber 20 within which the gears are mounted as best illustrated in FIG. 3. An outlet passage comprising portions 21 and **21*a*** leads to the hydraulically operated equipment, not shown.

The sides of the pumping chamber 20 within which the gears are mounted, are defined by side plates 15 more fully described hereinafter and shown in more detail in FIGS. 4 and 5. A preferred form of plate construction is shown in detail in FIGS. 4 and 5. The side plates fit within the housing and are designed to bear against the sides of the gear teeth.

As is best shown in FIG. 3, the interior of the housing is formed so that there is a substantial clearance space between the tips of the gear teeth at the addendum circle as shown at **10*a* and 11*a*, and the inner periphery of the housing well as shown at 22. This clearance space runs from the inlet region 19 circumferentially of each gear to a point at which radial sealing means are located adjacent the outlet 21. The distance between the teeth tips and the wall 22** on the low pressure side of the gears is such that under all anticipated load conditions the teeth do not contact the wall.

The radial sealing means preferably comprise shoes 23 which are separated for independent positioning adjacent each side of the outlet. Preferably the shoes 23 float within a semicircular recess machined into the housing **14*b* so as to extend across the entire face of the gears. The shoes extend at each end beyond the inner borders of the pressure plates and are dimensioned so that the pressure plates provide the sole support for the shoes which float within the semicircular recess. As can best be seen in FIG. 3 each is provided with a curved surface 24** whose radius is equal to the radius of the curved edge surfaces of the pressure plates.

When mounted within the recess, the shoes are separated by a space 25 which provides for communication between the gears and the discharge opening 21. Preferably, a pin **25*a* is mounted within one of the shoes and extends towards the opposite shoes so as to maintain the shoes in proper position when the pump is not operating. When the pump is operating a slight clearance is maintained between the bottom of the pin and the adjacent surface of the other shoe. In order to confine and limit the extent to which the discharge pressure is applied to the shoes, the back of each shoe is provided with a flexible sealing member 26 which is mounted in a recess 27 extending lengthwise of the shoes. The ends of this sealing member overlap the ends of sealing members 28 which fit within grooves in side sections of the housing 14*a* and 14*c*, to define sealed pressure regions behind the shoes and the side plates. It can be seen from FIG. 3, that the discharge pressure is communicated to this region behind the shoes as limited by the seals 26** and the seals in the side sections and acts to press the shoes against the edges of the side plates and into sealing relationship with the tips of the teeth. Preferably, the shoes are dimensioned when initially made so that when the pump is finally assembled, the gears track into the shoes slightly, cutting their final clearance, and thus assuring a good seal between the teeth and the shoes.

The discharge pressure is also communicated to the backs of the side plates within the confines of seal 28, the pressure balance on the plates being such that a seal is maintained with the sides of the teeth despite wear at the interfaces of the plates and the teeth.

Preferably the side plates have champhered portions 29 which are located adjacent to and in position so that they slightly overlap the shoes. These portions serve to provide a more gradual, less abrupt buildup of pressure as the teeth pass into sealing relationship with the shoes.

As should be evident from the above, the function of the shoes is to provide a fluid seal with the tips of those teeth 10*a* and 11*a* in the limited region immediately adjacent the high pressure side of the gears, which in the case of the pump is the outlet 21. As is shown in FIG. 3, these sealing shoes subdivide the interior of the housing into a relatively large inlet chamber portion which extends from inlet port 19 to the point where the teeth tips engage the surface of a shoe 23 wherein the fluid pressure is substantially zero and a relatively small outlet chamber portion wherein the pressure is the full discharge pressure.

Although the sealing surface of the shoes 23 can be made longer than is shown in FIG. 3, the preferred length of the sealing surface of each shoes is such that the tips of no more than two teeth at any given time are in full sealing relationship with the sealing surface of the shoes. In operation, this means that the full discharge pressure is limited in its application to the area of those teeth immediately adjacent the outlet. This pressure acts to push the shoes apart as viewed in FIG. 3 and also acts against the backs of the shoes within the limits of the space defined by seals 26. The net effect is to press the shoes into sealing relationship with the teeth. It should be noted that the fluid pressure in the cavity between any two teeth in sealing relationship with the elements 23 is at an intermediate value somewhat below the discharge pressure whereas the remainder of the cavity 20 which encompasses over two-thirds of the circumference of the gears is at low pressure.

Turning now to the construction of the side plates 15, the plates are preferably constructed of a hardened steel back portion 30 with a bronze layer 31 on the side adjacent to the gear teeth. Each plate 15 is preferably bored and counterbored and provided with an insert of hardened steel or other abrasion and erosion resistant material. The rings, shown at 32 in FIGS. 4 and 5 are secured mechanically against movement as by press fitting into the counterbored recesses of the side plates although in certain circumstances the rings may be made integral with the plates. The internal diameter of each ring is selected so as to clear the gear shafts. The external diameter of the rings must be at least equal to and preferably is slightly greater than the root circle gears 10 and 11. It is important that the hardened steel rings not extend appreciably beyond the root circle, due to the relatively high coefficient to friction of the steel as compared with that of the bronze bearing surface. It has been found that the friction effects existing between the side plates and the region of the gears extending from the outside diameter of the shaft to the root circle of the teeth are not appreciable whereas the frictional forces generated if the entire surface of the side plates were to be made of hardened steel would be so great as to cause overheating and a substantial shortening of the life of the pump or motor.

Other material than hardened steel may be employed, the criterion being that the material be resistant to the abrasive and erosive forces of the particulates likely to be encountered. Steel having a hardness of 40–45 Rockwell C produces excellent results.

Although the hardened steel rings are preferably press fitted into the counterbored openings in the side plates, it should be understood that if desired these rings could be secured with a swaging tool or be made integral with the hardened steel back portion of the side plates.

Figure 4:
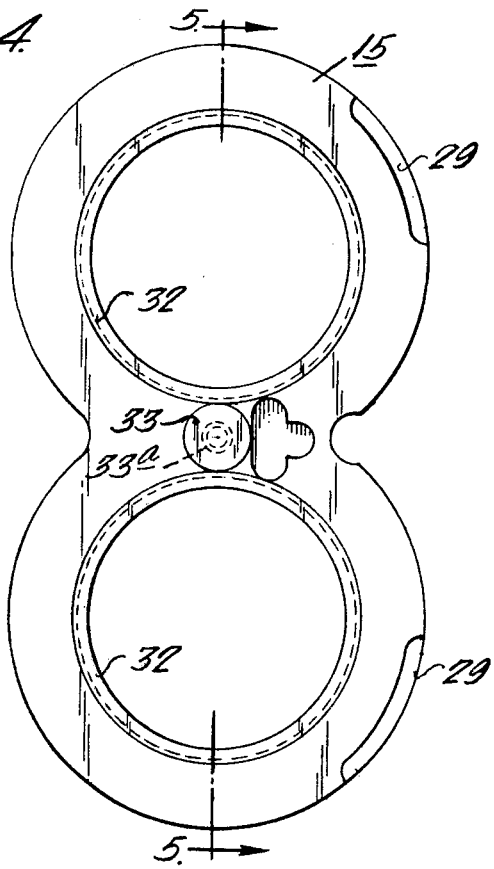
FIG. 4 is a detailed view of a side pressure plate incorporating the principles of the present invention.
Figure 5:
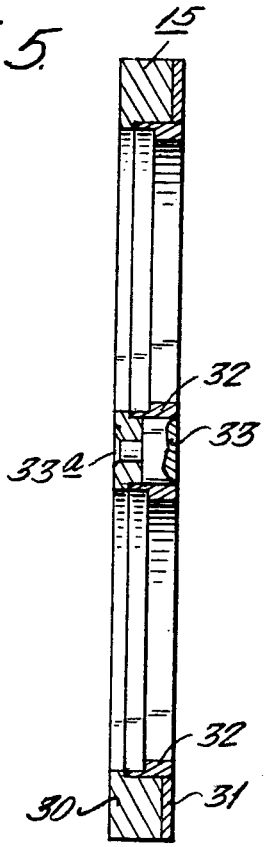
FIG. 5 is a section view taken on line 5—5 of FIG. 4.

As shown in FIG. 4, a hardened steel insert or button 33 is also provided in each plate in the region adjacent the mesh area of the teeth. In the preferred form of invention this insert extends through the plate and is secured thereto by having its end 33*a* upset.

Figure 6:
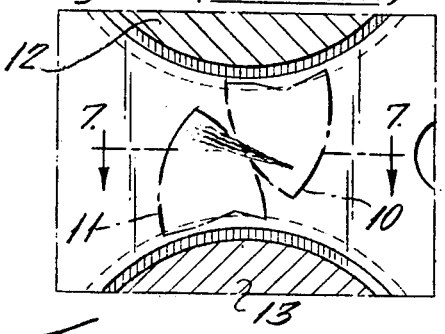
Fig. 6. (PRIOR ART)
FIG. 6 is a detailed sectional view of a side plate and the mesh region of the gears in a pump constructed according to the prior art.
Figure 8:
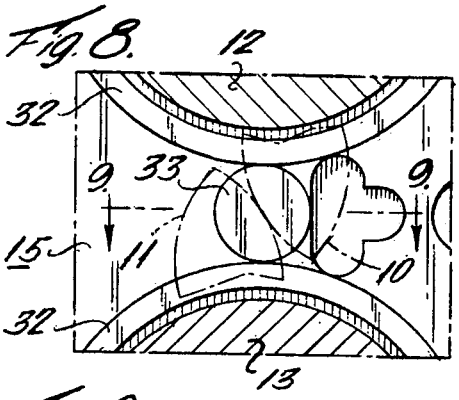
FIG. 8 is a detailed sectional view of a side plate constructed according to the present invention.
Figure 7:
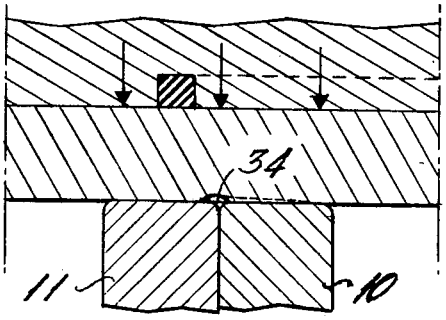
Fig. 7. (PRIOR ART)
FIG. 7 is a sectional view taken on line 7—7 of FIG. 6.
Figure 9:
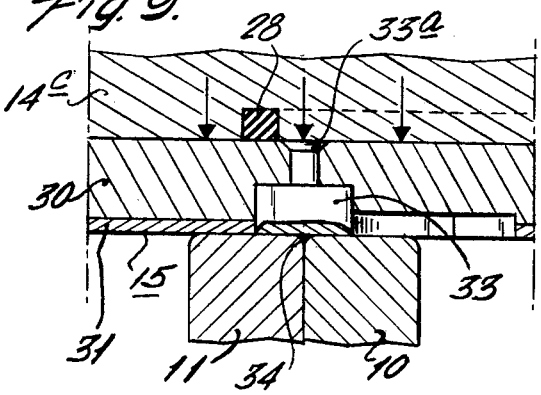
FIG. 9 is a sectional view taken on line 9—9 of FIG. 8.

FIG. 6 shows a wear plate constructed in accordance with the prior art, illustrating the effects of abrasion and erosion along the line of action of the gear teeth, As shown in FIG. 6, particulate in the oil abrades and erodes a channel in the bronze bearing material of the side plate. The reason for this is further illustrated in FIG. 7 which shows a pair of meshing teeth on gears 10 and 11. The edges of these teeth are either initially formed with a slight radius or are quickly worn to a slight radius during use, so that at the point of contact as shown at 34 in FIG. 7 a leakage path is formed through which particulate laden oil flows at very high pressure. The action of this oil very quickly forms the diametrrically shaped groove illustrated in FIG. 6. FIGS. 8 and 9 are views identical to FIGS. 6 and 7 except that the position of insert 33 is illustrated. Even though a small passageway still exists at the edges of the gear teeth as shown at 34, the wear resistant insert 32 prevents enlargement of this path and appreciable change in volumetric efficiency of the pump or motor.

In summary, in both instances, the abrasion and wear resistant material is provided within the pump or motor at a region where a relatively large pressure drop exists.

In the case of the rings 32, the region just exteriorly of the tooth root circle is at a higher pressure than the portion of the housing containing the bearings. Erosion and abrasion resistant rings are not employed. Particulate material carried by the oil abrades a passageway from the root circle to the shaft along the bearings 12*a* and 13*a*. Since this wear is not pressure compensated, the passage becomes progressively larger as more and more flow of particulate-laden material to the bearing drain takes place. The use of the abrasive resistant material in this region substantially eliminates this problem.

At the mesh area of the teeth, there is also an abrupt transition from a high pressure at one side of the mesh area to a low pressure at the other side. Separation of fluid between the side plates causes a higher degree of abrasion and erosion in this area than in the rest of the plate as a whole and this excess erosion is not adequately compensated for by the pressure acting on the back of the side plates. The presence of the hardened steel plates or buttons 33 substantially eliminate the problem of erosion and abrasion at this point.

Although the abrasion and erosion resistant side plates of the present invention are useful in gear pumps which do not have radially movable shoes, the combination or radially movable shoes and abrasive and erosive resistant side plates drastically reduces problems arising from the use of contaminant-laden fluids. Conventional pumps equipped with wear resistant rings and inserts have been shown to have a life at least five times the life of pumps not so equipped when run with fluid laden with contaminants. Pumps equipped with wear resistant rings, inserts and radially sealing shoes have been shown to have a life of at least fourty times that of pumps not so equipped. Pumps using the invention are particularly well suited for use in mining applications. A spark-free material such as cast iron can be used for the housing, the materials for the shoes and the major portion of the sealing surface of the side plates can be made of bronze whereas those areas subjected to greatest attack from abrasion and erosion can be made of hardened steel.

What is claimed is:

1. In hydraulic equipment of the gear type having intermeshing gears, a housing for the gears, gear support shafts within said housing and journal bearings supporting said shafts for rotation within said housing, bearing drain passages in said housing for maintaining said journal bearings at a relatively low pressure, a pair of floating pressure plates on opposite sides of said gears, said plates being mounted for movement axially of the shafts towards the sides of said gears, said plates having a flat surface of bronze or like bearing material on the plate side which faces said gears to form a bearing surface therewith, means for communicating the high pressure operating fluid to the sides of the plates which face away from the gears to urge the plates into sealing relationship with the sides of the gears, each plate having a pair of openings sized to provide clearance for the gear shafts, an insert of abrasion and erosion resistant material recessed within each opening, said inserts being secured against movement with respect to the plates and extending axially of the shafts from the plate sides facing the gears to the ends of the journal bearings and further extending radially from points adjacent the circumference of the gear shafts to the root circle of the gear teeth.

2. In equipment according to claim 1, further including a piece of abrasion and erosion resistant material inlaid in the bearing surfaces of each of said pressure plates, said pieces being flush with the bearing surface and each being dimensioned to cover the path followed by the point of contact of the meshing gear teeth.

3. Equipment according to claim 2, wherein said piece has a portion extending through the plate, and further wherein said portion is secured to the plate.

* * * * *